US010794073B2

(12) United States Patent
Self et al.

(10) Patent No.: US 10,794,073 B2
(45) Date of Patent: Oct. 6, 2020

(54) SYSTEMS AND METHODS FOR AN ENTERTAINMENT SYSTEM

(71) Applicant: Universal City Studios LLC, Universal City, CA (US)

(72) Inventors: Gregory Self, Orlando, FL (US); Kenneth Walker, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/192,456

(22) Filed: Nov. 15, 2018

(65) Prior Publication Data

US 2020/0157829 A1 May 21, 2020

(51) Int. Cl.
*E04H 3/26* (2006.01)
*B66B 9/04* (2006.01)
*B66F 7/08* (2006.01)

(52) U.S. Cl.
CPC ..... *E04H 3/26* (2013.01); *B66B 9/04* (2013.01); *B66F 7/08* (2013.01)

(58) Field of Classification Search
CPC ..... E04H 3/24; E04H 3/326; E04H 4/065; E04H 4/084; E04H 3/26; B66B 9/04; B01D 21/0012; B02B 15/04; B66F 7/08
USPC ..... 52/7, 2.13; 4/495, 499, 501, 507, 508
See application file for complete search history.

(56) References Cited

U.S. PATENT DOCUMENTS 1,223,515 A * 4/1917 Papanastasiou ..... F24F 7/007 454/230
3,413,661 A * 12/1968 Ross ..... E04H 4/065 4/501
3,566,420 A * 3/1971 Peterson et al. ..... E04H 4/084 4/494
3,935,600 A * 2/1976 Scribner ..... E04H 4/065 4/495
4,606,819 A * 8/1986 Colson ..... E04H 4/12 210/122
4,864,666 A * 9/1989 Sebastian ..... A47K 3/001 4/495
4,905,326 A * 3/1990 Nakamura ..... E04H 3/16 4/488

(Continued)

FOREIGN PATENT DOCUMENTS

CN 1975073 A 6/2007
CN 101761251 A 6/2010

(Continued)

OTHER PUBLICATIONS

Handling Speacialy, Custom Theather and Undewtaer Stage Systems, obtained from https://www.handling.com/product-categories/custom-theater-and-underwater-stage-systems/ (last accessed on Oct. 23, 2019) (Year: 2019).*

(Continued)

*Primary Examiner* — Theodore V Adamos
(74) *Attorney, Agent, or Firm* — Fletcher Yoder, P.C.

(57) ABSTRACT

An entertainment system includes a cylinder within a body of liquid, an entertainment platform within the cylinder, and a pump system. The entertainment platform is configured to move within the cylinder. The pump system is configured to remove fluid from and provide fluid to an interior of the cylinder on a first side of the entertainment platform to move the entertainment platform within the cylinder.

18 Claims, 6 Drawing Sheets

(56) References Cited

U.S. PATENT DOCUMENTS

| | | | | |
|---|---|---|---|---|
| 4,937,896 | A * | 7/1990 | Niimura | E04H 4/065 4/495 |
| 5,149,304 | A | 9/1992 | Purser | |
| 5,219,315 | A | 6/1993 | Fuller et al. | |
| 5,468,190 | A * | 11/1995 | McCaffrey | E04H 3/26 472/82 |
| 5,678,253 | A * | 10/1997 | Baker | E04H 4/065 254/89 R |
| 6,119,419 | A * | 9/2000 | Milanian | E04H 3/02 472/136 |
| 6,640,504 | B2 * | 11/2003 | Pearlson | E04H 4/065 4/495 |
| 7,811,448 | B2 * | 10/2010 | Johnson | B01F 1/0033 210/138 |
| 9,630,685 | B2 | 4/2017 | Lykov | |
| 10,072,430 | B2 * | 9/2018 | Nasibov | E04B 1/342 |
| 2003/0228195 | A1 * | 12/2003 | Mizutani | E04H 4/0012 405/52 |
| 2007/0220667 | A1 * | 9/2007 | Kanetis | E04H 4/065 4/501 |
| 2010/0199416 | A1 * | 8/2010 | Demoisson | E04H 4/065 4/495 |
| 2012/0131742 | A1 * | 5/2012 | Bernard | E04H 4/065 4/495 |
| 2013/0269097 | A1 * | 10/2013 | Alammari | E04H 4/065 4/495 |
| 2014/0014318 | A1 | 1/2014 | Mail | |
| 2014/0209546 | A1 * | 7/2014 | Smith | E04H 4/1272 210/776 |
| 2017/0175410 | A1 * | 6/2017 | Smith | E04H 4/1272 |

FOREIGN PATENT DOCUMENTS

| | | | |
|---|---|---|---|
| CN | 202689610 | U | 1/2013 |
| EP | 1988235 | | 11/2008 |
| JP | 08189216 | A * | 7/1996 |

OTHER PUBLICATIONS

Handling Specialty, City of Dreams Underwater Stage Lifts, https://www.handling.com/all-solutions/cityofdreams/ (can be obtained as early as Jun. 8, 2016 from https://web.archive.org/web/20160608095558/https://www.handling.com/all-solutions/cityofdreams/) (Year: 2016).*

Underwater Stage Lifts for Le Reve (handling Specialty Stage Lift Solutions https://www.youtube.com/watch?v=FJAppAehDb8 (Jul. 30, 2010) (Year: 2010).*

Handling Specialty, Underwater Stage Lifts for Cirque du Soleil's O Show, https://www.handling.com/all-solutions/underwater-stage-lifts-for-cirque-du-soleil/ (Jun. 8, 2016 from https://web.archive.org/web/20160608095553/http://www.handling.com/all-solutions/underwater-stage-lifts-for-cirque-du-soleil/) (Year: 2016).*

PCT/US2019/058579 International Search Report and Written Opinion dated Jan. 3, 2020.

* cited by examiner

SYSTEMS AND METHODS FOR AN ENTERTAINMENT SYSTEM

BACKGROUND

The disclosure relates generally to an entertainment system for an amusement park. More specifically, embodiments of the present disclosure relate to an entertainment platform of an entertainment system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Certain entertainment systems of an amusement park include entertainment platforms that may serve as a stage for a performance or that may be utilized for other purposes. For example, entertainment platforms may be included as part of an amusement ride in the amusement park. Such entertainment platforms are typically stationary within the entertainment system or may be moved by traditional hydraulic systems. However, stationary entertainment platforms may limit aspects of a performance on the entertainment platform. Additionally, the use of traditional hydraulic systems to move an entertainment platform may require extensive maintenance of the entertainment system, the traditional hydraulic systems may be susceptible to wear and degradation, and the traditional hydraulic systems may have increased costs associated with operation of the entertainment system.

BRIEF DESCRIPTION

Certain embodiments commensurate in scope with the originally claimed embodiments are summarized below. These embodiments are not intended to limit the scope of the claimed embodiments, but rather these embodiments are intended only to provide a brief summary of possible forms of the claimed embodiments. Indeed, the present disclosure may encompass a variety of forms that may be similar to or different from the embodiments set forth below.

In a first embodiment, an entertainment system includes a cylinder disposed within a body of liquid, an entertainment platform disposed within the cylinder, and a pump system. The entertainment platform is configured to move within the cylinder. The pump system is configured to remove fluid from and provide fluid to an interior of the cylinder on a first side of the entertainment platform to move the entertainment platform within the cylinder.

In a second embodiment, an entertainment system includes a body of liquid and a cylinder disposed within the body of liquid. The cylinder includes a top portion and a bottom portion. The entertainment system also includes an entertainment platform disposed within an interior of the cylinder. The entertainment platform is configured to move axially within the cylinder between a first position at the bottom portion of the cylinder and a second position at the top portion of the cylinder. Further, the entertainment system includes a pump system and a first conduit fluidly coupled to the pump system and the interior of the cylinder at the bottom portion. The pump system is configured to selectively provide and remove a flow of liquid to and from the interior of the cylinder at the bottom portion to move the entertainment platform between the first position and the second position.

In a third embodiment, a method of providing an entertainment platform in a body of liquid includes removing liquid from an interior of a cylinder on a first side of the entertainment platform disposed within the cylinder, where the cylinder is disposed within the body of liquid. The method also includes providing liquid to the interior of the cylinder on a second side of the entertainment platform to lift the entertainment platform within the cylinder, and removing the liquid from the interior of the cylinder on the second side of the entertainment platform to lower the entertainment platform within the cylinder.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
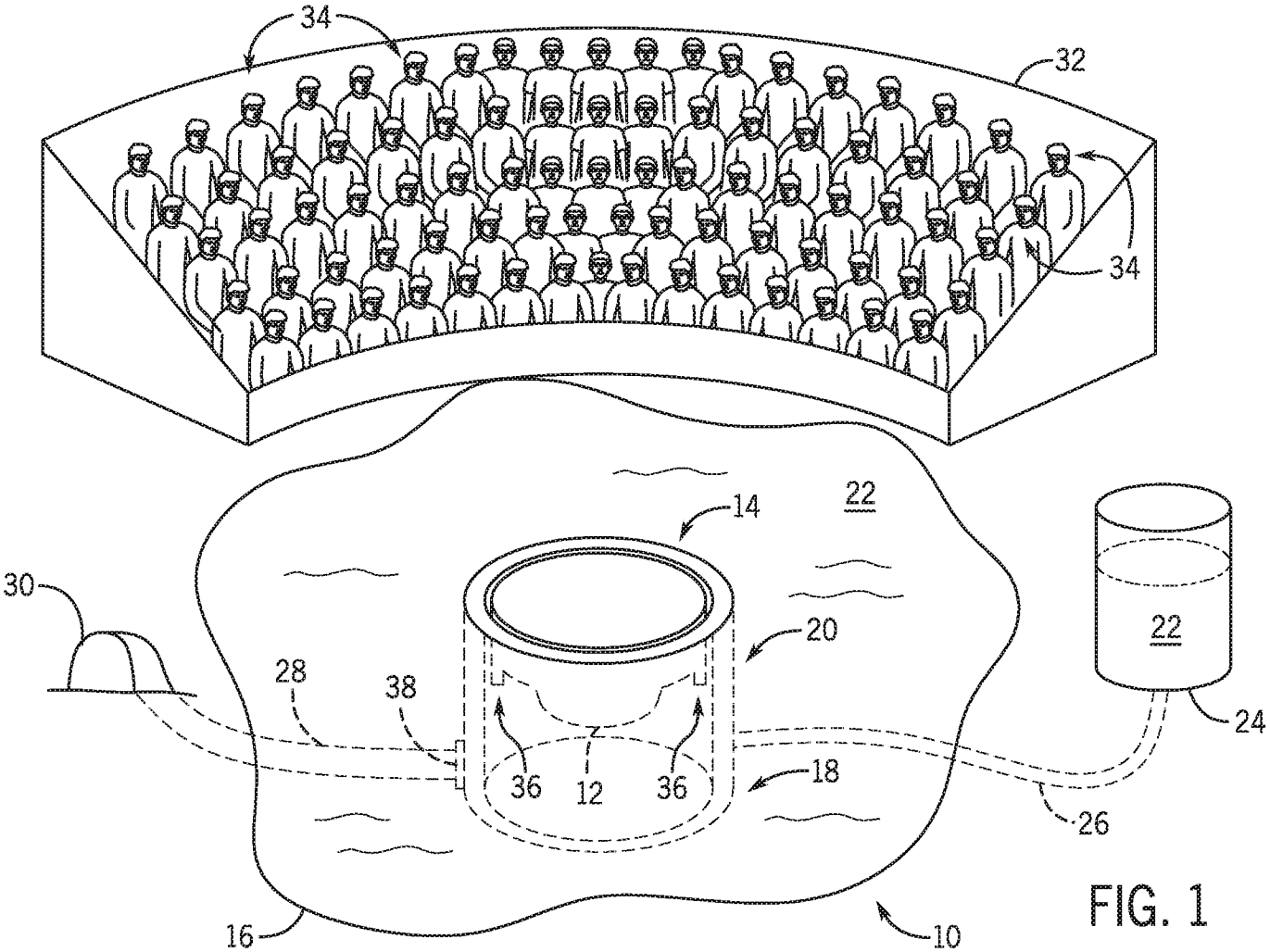
FIG. 1 is a perspective view of an embodiment of an entertainment system having an entertainment platform, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure are directed to systems and methods for an entertainment platform of an entertainment system. In certain embodiments, the entertainment platform may serve as a stage for a performance in the entertainment system. In other embodiments, the entertainment system may be an amusement ride or a portion thereof, and the entertainment platform may be used for a variety of purposes within the amusement ride. As discussed in detail below, the entertainment system may include a body of liquid (e.g., a body of water) and a cylinder disposed within the body of fluid. The entertainment platform may be disposed within the cylinder. While the present discussion describes the disclosed techniques as including a cylinder and an entertainment platform having a complementary geometry disposed therein, it should be appreciated that other embodiments employing the present techniques may include other non-cylindrical structures, such as a hollow rectangular prism, and corresponding entertainment platforms having complementary geometries.

The entertainment system may also include a pump that moves liquid to and from the body of liquid, as well as to and from an inner volume of the cylinder, via one or more conduits. For example, the pump may remove liquid from a top portion or volume within the cylinder and above the entertainment platform within the body of liquid. The entertainment system may store the removed liquid in a reservoir separate from the cylinder and the body of liquid. The entertainment system may further enable performer(s), object(s), and other aspects or elements of the entertainment system to be moved onto the entertainment platform within the cylinder when the liquid is removed from the top volume within the cylinder and above the entertainment platform.

Once any desired equipment, performers, components, or other elements are positioned on the entertainment platform, the pump may provide liquid to a bottom portion or volume of the cylinder below the entertainment platform to cause the entertainment platform to move or rise within the cylinder toward the top portion or volume of the cylinder. The pump may use the liquid stored in the reservoir to raise the entertainment platform within the cylinder. The performer(s), the object(s), and the other elements of the entertainment system may be disposed on the entertainment platform as the entertainment platform moves from the bottom portion or volume of the cylinder to the top portion or volume of the cylinder. When the entertainment platform is disposed generally at or near the top portion of the cylinder, the performer(s), the object(s), and the other aspects of the entertainment system may be visible near a surface of the body of liquid and may proceed to perform an entertainment act or other operation. The performance may be viewed by guests in a viewing area adjacent to or on the body of liquid.

Thereafter, the pump may remove the liquid from the area or volume within the cylinder that is below the entertainment platform to cause the entertainment platform to lower within the cylinder and return to the bottom portion of the cylinder. The liquid removed from the volume below the entertainment platform may be stored in the reservoir. After returning to the bottom portion of the cylinder, the performer(s), the object(s), and the other elements of the entertainment system may be removed from the entertainment platform. Additionally, the pump may fill the volume above the entertainment platform and within the cylinder and/or may fill the body of liquid with the liquid stored in the reservoir. For example, the pump may move the liquid stored in the reservoir back into the internal volume cylinder and/or into the body of liquid. As such, embodiments of the entertainment system described herein may provide an entertainment platform that moves within a cylinder disposed in a body of liquid. The entertainment platform may serve as a performance stage for viewing by guests of an amusement park.

Turning to the drawings, FIG. 1 is a perspective view of an embodiment of an entertainment system 10 having an entertainment platform 12. The entertainment system 10 and the entertainment platform 12 may be used for a variety of purposes within an amusement park or similar attraction. For example, the entertainment system 10 may include or be located in a performance area (e.g., an indoor or outdoor theatre), and the entertainment platform 12 may be a stage for a performance by performer(s), object(s) (e.g., instruments, fireworks, animatronics), and the other elements of the performance. The entertainment system 10 may also be an amusement ride. For example, the entertainment platform 12 may be disposed along a ride track of the amusement ride within the amusement park, and the entertainment platform 12 may be used to enhance or supplement the amusement ride experience.

As illustrated, the entertainment system 10 includes a cylinder 14 and a body of liquid 16. The entertainment platform 12 is disposed generally within the cylinder 14 (e.g., within an internal volume of the cylinder 14), and the cylinder 14 is disposed generally within the body of liquid 16. The entertainment platform 12 may move axially within the cylinder 14 (e.g., along a central or longitudinal axis of the cylinder 14) from a bottom volume or portion 18 of the cylinder 14 to a top volume or portion 20 of the cylinder 14, and vice versa. While disposed generally at the bottom portion 18, the entertainment platform 12 may be submerged by liquid 22 (e.g., water) disposed within and over the cylinder 14. For example, the liquid 22 may form a generally continuous layer of liquid over the cylinder 14 and at a surface of the body of liquid 16. In these conditions, the cylinder 14 is submerged within the body of liquid 16. The liquid 22 above the entertainment platform 12 (i.e., the liquid 22 within and over the cylinder 14) may be removed to enable performer(s) and object(s) to move onto the entertainment platform 12. The entertainment platform 12 may move to the top portion 20 of the cylinder 14 with the performer(s) and the object(s) disposed thereon. As illustrated, the entertainment platform 12 is disposed at the top portion 20 of the cylinder 14. While disposed at the top portion 20, the entertainment platform 12 and/or performer(s) and object(s) disposed on the entertainment platform 12 may be visible to guests 34 in a viewing area 32. As illustrated, the viewing area 32 is disposed adjacent to the body of liquid 16. In certain embodiments, the viewing area 32 may be disposed on the body of liquid 16, over the body of liquid 16, or at other locations within or near the entertainment system 10. Additionally, in certain embodiments, the viewing area 32 and/or the body of liquid 16 may move relative to one another.

To move the entertainment platform 12 within the cylinder 14, the entertainment system 10 may use the liquid 22 previously removed from the cylinder 14 and/or from the body of liquid 16. For example, as the liquid 22 is removed from the cylinder 14 and/or from the body of liquid 16, the liquid 22 may be stored in a reservoir 24. As illustrated, the reservoir 24 is a cylindrical tank that includes a portion of the liquid 22. In certain embodiments, the reservoir 24 may be a pond, an underground tank, or another system or area separate from the body of liquid 16 that stores liquid 22 removed from within the cylinder 16 and/or from the body of liquid 16. The liquid 22 removed from the cylinder 14 and/or removed from the body of liquid 16 may move through one or more conduits 26 of the entertainment system 10 to be stored in the reservoir 24. Additionally, a pump and a valve disposed along the one or more conduits 26 may control a flow of the liquid 22 to and from the reservoir 24. In certain embodiments, a hydrostatic force of the liquid 22 (e.g., within the cylinder 16, body of liquid 16, and/or reservoir 24) may enable the valve to flow liquid to and/or from the reservoir 24 with minimal or no use of the pump. In some embodiments, the entertainment system 10 may also use other liquid and/or other fluids to move the entertainment platform 12 within the cylinder 14.

After removing a portion of the liquid 22 from the cylinder 14 and the body of liquid 16, the entertainment system 10 may provide the liquid 22 stored in the reservoir 24 to the bottom portion 18 of the cylinder 14 in an area below the entertainment platform 12 to drive movement of the entertainment platform 12 within the cylinder 14 toward the top portion 20 of the cylinder 14. Specifically, as the liquid 22 is pumped into the bottom portion 18 of the cylinder 14, the addition of liquid 22 will force the entertainment platform 12 upward within the cylinder 14. In certain embodiments, the entertainment system 10 may include seals disposed between the entertainment platform 12 and the cylinder 14 to block flow of liquid 22 between the cylinder 14 and the entertainment platform 12 when the liquid 22 is pumped into the bottom portion 18 of the cylinder 14. The entertainment platform 12 may also include a skirt 36 disposed about a circumference of the entertainment platform 12. The skirt 36 may extend generally axially from a circumference of the main body of the entertainment platform 12 to contact an interior of the cylinder 14 and enable the entertainment platform 12 to remain generally level within the cylinder 14 when the entertainment platform 12 is stationary and/or moving within the cylinder 14.

The entertainment platform 12 may also move within the cylinder 14 from the top portion 20 toward the bottom portion 18. For example, the entertainment platform 12 may move from the top portion 20 toward the bottom portion 18 with the performer(s) and/or the object(s) disposed on the entertainment platform 12. Once disposed at the bottom portion 18 of the cylinder 14, the performer(s) and/or the object(s) may exit the entertainment platform 12, as described in further detail below. Thereafter, the entertainment system 10 may fill the cylinder 14 and the body of liquid 16 with the liquid 22 from the reservoir 24. The entertainment system 10 may supply the liquid directly from the reservoir 24 to the top portion 20 of the cylinder 14, such as via a conduit there between, or the liquid 22 may be supplied to the top portion 20 of the cylinder 14 via the body of liquid 16. In certain embodiments, the entertainment system 10 may fill the cylinder 14 and the body of liquid 16 until the liquid 22 is at the generally continuous level over the cylinder 14 described above.

In certain embodiments, the entertainment system 10 may include a passageway 28 extending between an entrance 30 and an access panel 38 of the cylinder 14 to enable the performer(s) and/or object(s) to enter onto and/or exit from the entertainment platform 12 within the cylinder 14. For example, the performer(s) and/or the object(s) may enter the passageway 28 via the entrance 30. The entrance 30 may be disposed generally adjacent to and generally higher in elevation than the body of liquid 16, may be disposed in a room adjacent to and separate from the body of liquid 16, or may be positioned in other locations. As will be appreciated, the passageway 28 may be constructed and sized to enable passage of performers and equipment therethrough, and the passageway 28 may be designed and configured to block passage of liquid 22 into the passageway 28. When the entertainment platform 12 is disposed at the bottom portion 18 of the cylinder 14, and the liquid 22 is removed from the area above the entertainment platform 12, the performer(s) and/or the object(s) may enter onto or into the entertainment platform 12 via the access panel 38. The access panel 38 may be a part of and/or coupled to the cylinder 14. The performer(s) and/or the object(s) may also exit the entertainment platform 12 and enter the passageway 28 via the access panel 38. Further, the performer(s) and/or the object(s) may exit the passageway 28 via the entrance 30 or via other means.

Figure 2:
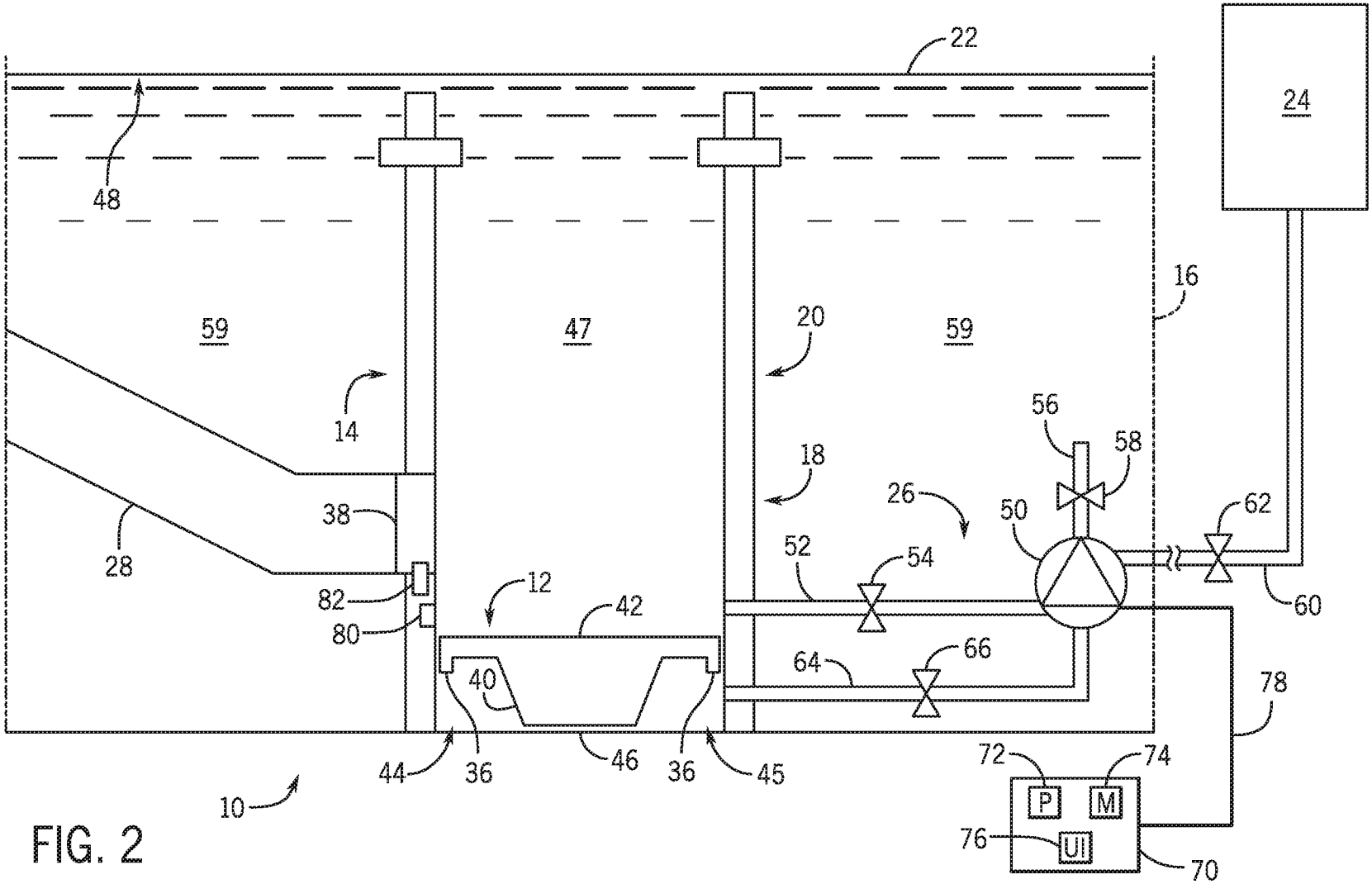
FIG. 2 is a partial cross-sectional side view of an embodiment of the entertainment system of FIG. 1, in accordance with aspects of the present disclosure.

FIG. 2 is a partial cross-sectional side view of an embodiment of the entertainment system 10 of FIG. 1. In the illustrated embodiment, the entertainment system 10 includes the entertainment platform 12 positioned within the bottom portion 18 of the cylinder 14. The liquid 22 covers the entertainment platform 12 and the cylinder 14 to form a continuous liquid surface 48. For example, guests viewing the body of liquid 16 may see the continuous liquid surface 48, and the entertainment platform 12 and/or the cylinder 14 may be hidden from the view of the guests. As such, the guests may be initially unaware of the presence of the entertainment platform 12 within the body of liquid 16 and other aspects of the entertainment system 10.

As illustrated, the entertainment platform 12 includes an extension 40 and a surface 42, which is a surface on which performers, equipment, or other elements may be disposed. The extension 40 is disposed on a first side 44 of the entertainment platform 12 within the cylinder 14 (i.e., in an area generally below the entertainment platform 12 within the cylinder 14). The extension 40 may extend opposite and away from the surface 42, such that the extension 40 extends into an internal volume of the cylinder 14 on the first side 44. For example, when the entertainment platform 12 is positioned at a bottommost portion of the cylinder 14, a gap or cavity 45 is formed between the cylinder 14 and the entertainment platform 12 on the first side 44 of the entertainment platform 12. As shown, the extension 40 extends into, adjacent to, and/or through the gap or cavity 45 to contact a bottom surface 46 of the formation containing cylinder 14 and the body of liquid 22. The entertainment system 10 may also include a second side 47 of the entertainment platform 12 within the cylinder 14, where the second side 47 is disposed adjacent to the surface 42 (i.e., an area generally above the entertainment platform 12 within the cylinder 14). As illustrated, both the first side 44 and the second side 47 of the entertainment platform 12 within the cylinder 14 are filled with the liquid 22. As the entertainment platform 12 moves within the cylinder 14, respective internal volumes of the cylinder 14 disposed the first side 44 and/or the second side 47 increase and/or decrease.

The entertainment system 10 may include a pump 50 (e.g., a pump system) configured to remove the liquid 22 from and provide the liquid 22 to the cylinder 14, the body of liquid 16, the reservoir 24, or a combination thereof, via the one or more conduits 26 and/or valves. As illustrated, the pump 50 is coupled to a first conduit 52. The first conduit 52 extends from the pump 50 to the cylinder 14 on the second side 47 of the entertainment platform 12 when the entertainment platform 12 is positioned near or adjacent the bottom surface 46 of the formation containing the cylinder 14 and the body of liquid 22. The first conduit 52 includes a first valve 54 and is configured to flow the liquid 22 from the cylinder 14 to the pump 50, and vice versa. For example, prior to the performer(s) and/or the object(s) moving onto the entertainment platform 12 disposed at the bottom portion 18 of the cylinder 14, the first valve 54 may open to enable the pump 50 to remove the liquid 22 from the second side 47 of the entertainment platform 12 via the first conduit 52. As a result, the liquid 22 may flow out of the cylinder 14 along the first conduit 52 and toward the pump 50. In certain embodiments, the first conduit 52 may flow the liquid 22 back into the cylinder 14 on the second side 47 of the entertainment platform 12 after the performer(s) and/or the object(s) exit the entertainment platform 12 (e.g., via the access panel 38 and passageway 28).

As illustrated, the pump 50 is also coupled to a second conduit 56. The second conduit 56 extends from the pump 50 to a main volume 59 of the body of liquid 16. The main volume 59 is disposed generally around the cylinder 14 within the body of liquid 16. The second conduit 56 includes a second valve 58 and is configured to flow the liquid 22 from the main volume 59 of the body of liquid 16 toward the pump 50, and vice versa. For example, prior to the performer(s) and/or the object(s) moving onto the entertainment platform 12, the second valve 58 may open to enable the pump 50 to remove the liquid 22 from the main volume 59 of the body of liquid 16 via the second conduit 56. As a result, the liquid 22 may flow out of the body of liquid 16 along the second conduit 56 and toward the pump 50. In certain embodiments, the second conduit 56 may flow the liquid 22 back into the main volume 59 of the body of liquid 16 after the performer(s) and/or the object(s) exit the entertainment platform 12.

As illustrated, the pump 50 is further coupled to a third conduit 60. The third conduit 60 extends from the pump 50 to the reservoir 24. As described herein, the reservoir 24 is disposed separate from the body of liquid 16, but the reservoir 24 may be disposed in other locations relative to the body of liquid 16 in other embodiments. The third conduit 60 includes a third valve 62 and is configured to flow the liquid 22 from the pump 50 to the reservoir 24, and vice versa. For example, prior to the performer(s) and/or the object(s) moving onto the entertainment platform 12, the second valve 62 may open to enable the pump 50 to move the liquid 22 from the cylinder 14 and from the body of liquid 16 to the reservoir 24 via the third conduit 60. As a result, the liquid 22 may flow out of the cylinder 14 and the body of liquid 16, through the pump 50, and to the reservoir 24 until the liquid level is below or even with a top of the cylinder 14. In certain embodiments, the third conduit 60 may flow the liquid 22 back to the pump 50 when the liquid 22 within the reservoir 24 is to be supplied back to the body of liquid 16 and/or into the cylinder 14.

As illustrated, the pump 50 is coupled to a fourth conduit 64. The fourth conduit 64 extends from the pump 50 to the cylinder 14 on the first side 44 of the entertainment platform 12 when the entertainment platform 12 is disposed within the bottom portion 18 of the cylinder 14. The fourth conduit 64 includes a fourth valve 66 and is configured to flow the liquid 22 from the cylinder 14 to the pump 50, and vice versa. For example, after the performer(s) and/or the object(s) move onto the entertainment platform 12, the fourth valve 66 may open to enable the pump 50 to provide the liquid 22 into the cylinder 14 on the first side 44 of the entertainment platform 12 via the fourth conduit 64. In this manner, the liquid 22 pumped into the cylinder 14 on the first side 44 of the entertainment platform 12 will force the entertainment platform 12 axially upward within the cylinder 14 from the bottom portion 18 toward the top portion 20.

In certain embodiments, the fourth conduit 64 may flow the liquid 22 back toward the pump 50 to remove the liquid 22 from the first side 44 of the entertainment platform 12 within the cylinder 14. Removing the liquid 22 from the first side 44 may cause the entertainment platform 12 to lower within the cylinder 14 from the top portion 20 toward to the bottom portion 18. For example, after a performance by the performer(s) and/or the object(s) on the entertainment platform 12, the fourth valve 66 may open to enable the pump 50 to remove the liquid 22 from the first side 44 to cause the entertainment platform 12 to lower toward the bottom portion 18.

In certain embodiments, the pump 50 of the entertainment system 10 may include additional pumps configured to move liquid along certain conduits. For example, the entertainment system 10 may include a first pump coupled to the first conduit 52 and configured to move the liquid 22 along the first conduit 52, a second pump coupled to the second conduit 56 and configured to move the liquid 22 along the second conduit 56, a third pump coupled to the third conduit 60 and configured to move the liquid 22 along the third conduit 60, a fourth pump coupled to the fourth conduit 64 and configured to move the liquid 22 along the fourth conduit 64, or a combination thereof. In certain embodiments, each of the first pump, the second pump, the third pump, and/or the fourth pump may be coupled to the pump 50. In certain embodiments, the entertainment system 10 may include more or fewer pumps, conduits, and valves. For example, the first conduit 52 and the fourth conduit 64 may be coupled to a single pump separate from the pump 50. Additionally, each of the pumps, conduits, and valves of the entertainment system 10 may flow the liquid 22 in multiple directions and/or to multiple locations. For example, the pump 50 may cause the liquid 22 to flow through the first conduit 52 and the first valve 54 toward the pump 50 in a first instance and through the first conduit 52 and the first valve 54 toward the cylinder 14 in a second instance. Indeed, there are many possible combinations and configurations of pumps, valves, and conduits that may be used with the present techniques for the entertainment system 10.

The entertainment system 10 may further include a controller 70 that may enable a user to control certain portion(s) and/or operations of the entertainment system 10 and/or that may automatically control certain portion(s) and/or operations of the entertainment system 10. For example, the controller 70 may regulate operation of components of the entertainment system 10 to control the flow of the liquid 22 through the pump 50, the first conduit 52, the second conduit 56, the third conduit 60, the fourth conduit 64, or a combination thereof. For example, the controller 70 may control a position of the valves (e.g., the first valve 54, the second valve 58, the third valve 62, and the fourth valve 66) to control the flow through the pump 50 and the conduits (e.g., the first conduit 52, the second conduit 56, the third conduit 60, and the fourth conduit 64). The controller 70 may also regulate operation of the valves to control respective flow-rate(s) of the liquid 22 through each conduit.

The controller 70 may include a processor 72, a memory 74, a user interface 76, or a combination thereof. The processor 72 may include multiple microprocessors, one or more "general-purpose" microprocessors, one or more special-purpose microprocessors, one or more application specific integrated circuits (ASICS), and/or one or more reduced instruction set (RISC) processors, or some combination thereof. The memory 74 may include a volatile memory, such as random access memory (RAM), and/or a nonvolatile memory, such as ROM, a hard drive, a memory card, a memory stick (e.g., USB stick) and so on. The memory 74 may include and store computer programs or instructions executable by the processor 72 and suitable for controlling the entertainment system 10. The memory 74 may further include and store computer programs or instructions executable by the processor 72 and suitable for detecting various values, such as operation parameters of the entertainment system 10, and providing control actions. The user interface 76 may enable a user (e.g., an operator or technician) of the entertainment system 10 to control certain functions or parameters of the entertainment system 10. Such functions or parameters may include the respective positions of certain valves along the conduits, flowrates of liquid 22 through the conduits and/or the pump 50, and other aspects of the entertainment system 10 related to the flow of the liquid 22 or general operation of the entertainment system 10.

As illustrated, the controller 70 is communicatively coupled to the pump 50 via a wired connection 78 (e.g., Ethernet, universal serial bus (USB), canbus, ISObus, etc.). In certain embodiments, the controller 70 may be communicatively coupled to the pump 50 via a wireless connection (e.g., wireless internet (WIFI), Bluetooth, etc.). The controller 70 may output signals to and receive signals (e.g., controls signals, feedback signals, etc.) from the pump 50 via the wired connection 78 and/or via the wireless connection to control the operation of the pump 50. In some embodiments, the controller 70 may also be communicatively coupled to the valves (e.g., the first valve 54, the second valve 58, the third valve 62, and the fourth valve 66) and/or to other components of the entertainment system 10 via a wired connection and/or a wireless connection to control certain functions.

As illustrated and mentioned above, the cylinder 14 is coupled to the passageway 28 via the access panel 38. The access panel 38 may open and close to enable the performer(s), the object(s), or both, to enter and exit the interior volume of the cylinder 14. In the illustrated embodiment, the access panel 38 is in a closed position to maintain a liquidtight seal between the passageway 28 and the liquid 22 disposed in the cylinder 14.

In certain embodiments, the entertainment system 10 may include a sensor 80 configured to detect a presence of the liquid 22 within the bottom portion 18 of the cylinder 14. The sensor 80 may include a camera or another type of sensor configured to detect the presence of liquid 22. The entertainment system 10 may also include a locking mechanism 82 that may lock the access panel 38 in a closed position. For example, the locking mechanism 82 may lock the access panel 38 in the closed position based on the detection of the liquid 22 within the bottom portion 18 of the cylinder 14. If the sensor 80 detects the presence of the liquid 22 in the cylinder 14, the locking mechanism 82 may lock the access panel 38 in response, and, in certain embodiments, the access panel 38 may remain in the locked position via the locking mechanism 82 until the liquid 22 is removed from the bottom portion 18 of the cylinder 14. In this manner, the performer(s), the object(s), or both may be prevented from entering the cylinder 14 via the access panel 38 while the liquid 22 is disposed in the bottom portion 18. Additionally, the liquid 22 may be contained within the cylinder 14 and may not flow into the passageway 28 via the access panel 38.

The sensor 80 and/or the locking mechanism 82 may be communicatively coupled to the controller 70 and/or to another controller of the entertainment system 10. For example, the sensor 80 may output signal(s) (e.g., feedback signals) to the controller 70 and/or to another controller indicating the presence of the liquid 22 within the cylinder 14. In response, the controller 70 and/or the other controller may automatically output signal(s) (e.g., control signals) to the locking mechanism 82 to cause the locking mechanism 82 to lock the access panel 38 in the closed position. The controller 70 may also display or output a notification (e.g., an alert, a message, etc.) to the user interface 76 of the controller 70 indicative of the presence of the liquid 22 within the cylinder 14. In certain embodiments, the controller 70 may display or output the notification indicative of the presence of liquid 22, the user (e.g., the operator) of the entertainment system 10 may receive the notification, and the user may then interact with the user interface 76 to cause the controller 70 to output the signal to the locking mechanism 82 to cause the locking mechanism 82 to lock the access panel 38. In such a case, the controller 70 may not automatically output a signal to the locking mechanism 82 to cause the locking mechanism 82 to lock the access panel 38 in the closed position.

Figure 3:
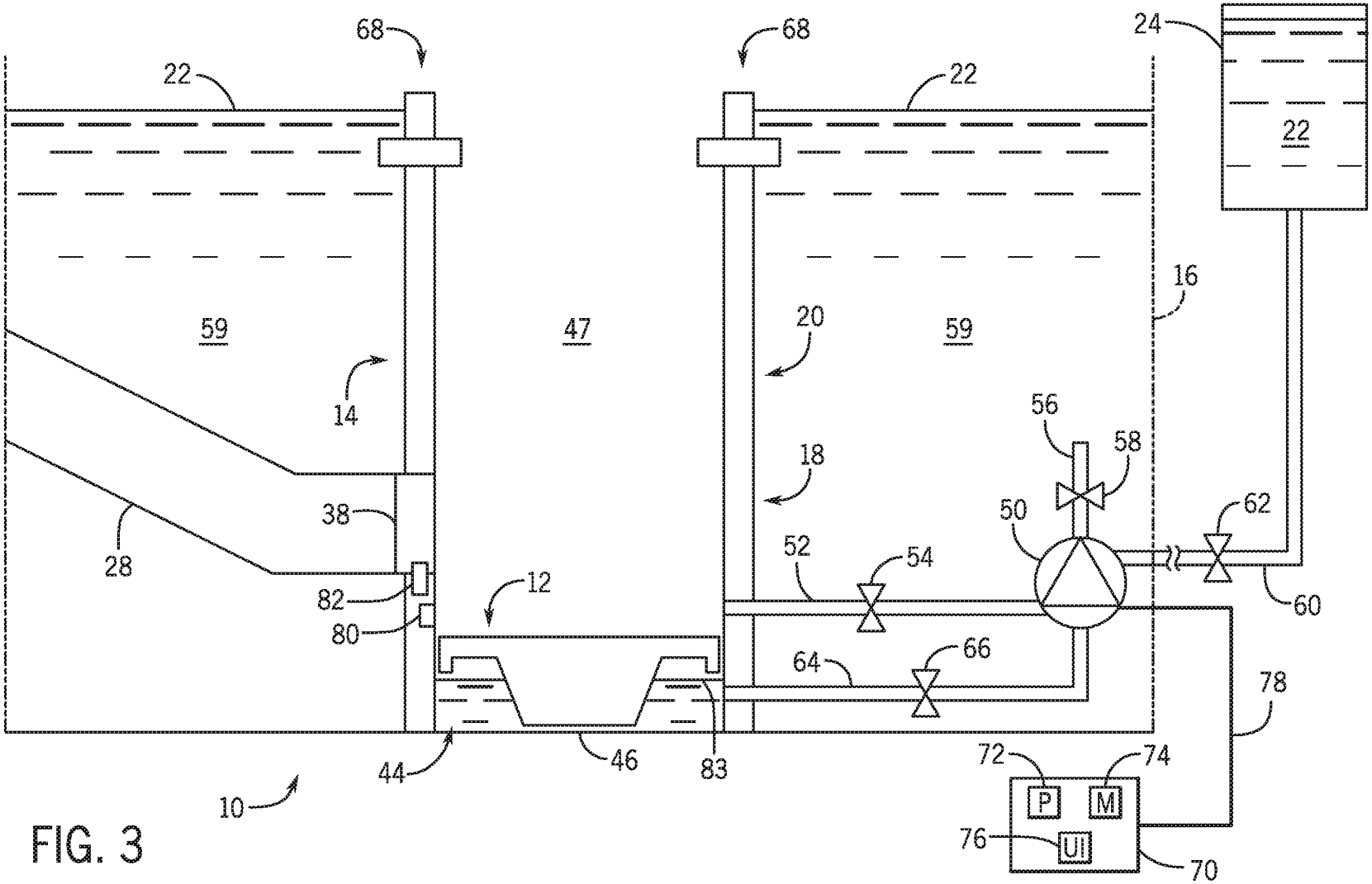
FIG. 3 is a partial cross-sectional side view of an embodiment of the entertainment system of FIG. 1, in accordance with aspects of the present disclosure.

FIG. 3 is a partial cross-sectional side view of an embodiment of the entertainment system 10 of FIG. 1. The illustrated embodiment shows the entertainment platform 12 of the entertainment system 10 disposed within the bottom portion 18 of the cylinder 14. In the illustrated embodiment, the pump 50 has removed the liquid 22 from the second side 47 of the entertainment platform 12 within the cylinder 14 via the first conduit 52 and the first valve 54. The pump 50 has also removed a portion of the liquid 22 in the main volume 59 of the body of liquid 16 via the second conduit 56 and the second valve 58 to drop the liquid level of the body of liquid 16 below a top surface or axial end 68 of the cylinder 14. As illustrated, the liquid within the cylinder 14 is at a level 83 generally below the entertainment platform 12. In certain embodiments, the level 83 may be at generally the same level as the entertainment platform 12. Some of the liquid 22 remains disposed in the main volume 59. The liquid 22 removed from within the cylinder 14 and within the main volume 59 may be pumped to the reservoir 24 via the pump 50, the third conduit 60, and the third valve 62.

In the illustrated embodiment, the sensor 80 may detect that that the liquid 22 is not present on the second side 47 of the entertainment platform 12 when the entertainment platform 12 is disposed in the bottom portion 18 of the cylinder 14. The sensor 80 may output a sensor signal to the controller 70 indicative of the absence of the liquid 22 on the second side 47 of the entertainment platform 12. In response to receiving the sensor signal, the controller 70 may output a control signal to the locking mechanism 82 to cause the locking mechanism 82 to unlock the access panel 38 (e.g., if the locking mechanism 82 was in a locked configuration). In response to receiving the control signal, the locking mechanism 82 may unlock and/or may open the access panel 38. In certain embodiments, a user (e.g., a performer or an assistant) may open the access panel 38. After opening the access panel 38, the performer(s), the object(s), or the combination thereof, may enter the cylinder 14 onto the entertainment platform 12 via the passageway 28 and the access panel 28. In some embodiments, the access panel 38 may be closed again after the performer(s), the object(s), or both, enter the cylinder 14 onto the entertainment platform 12.

In the illustrated embodiment, the guests viewing the body of liquid 16 may see the liquid 22 disposed generally about the cylinder 14. From the perspective of the guests, the inner volume of the cylinder 14 may appear as an empty space within the body of liquid 16. Indeed, the guests may not have prior knowledge of the content or elements of the entertainment system 10 and may not know what to expect from the empty space within the cylinder 14 and the body of liquid 16. As such, the entertainment system 10 may provide an exciting and suspenseful entertaining venue for the guests.

Figure 4:
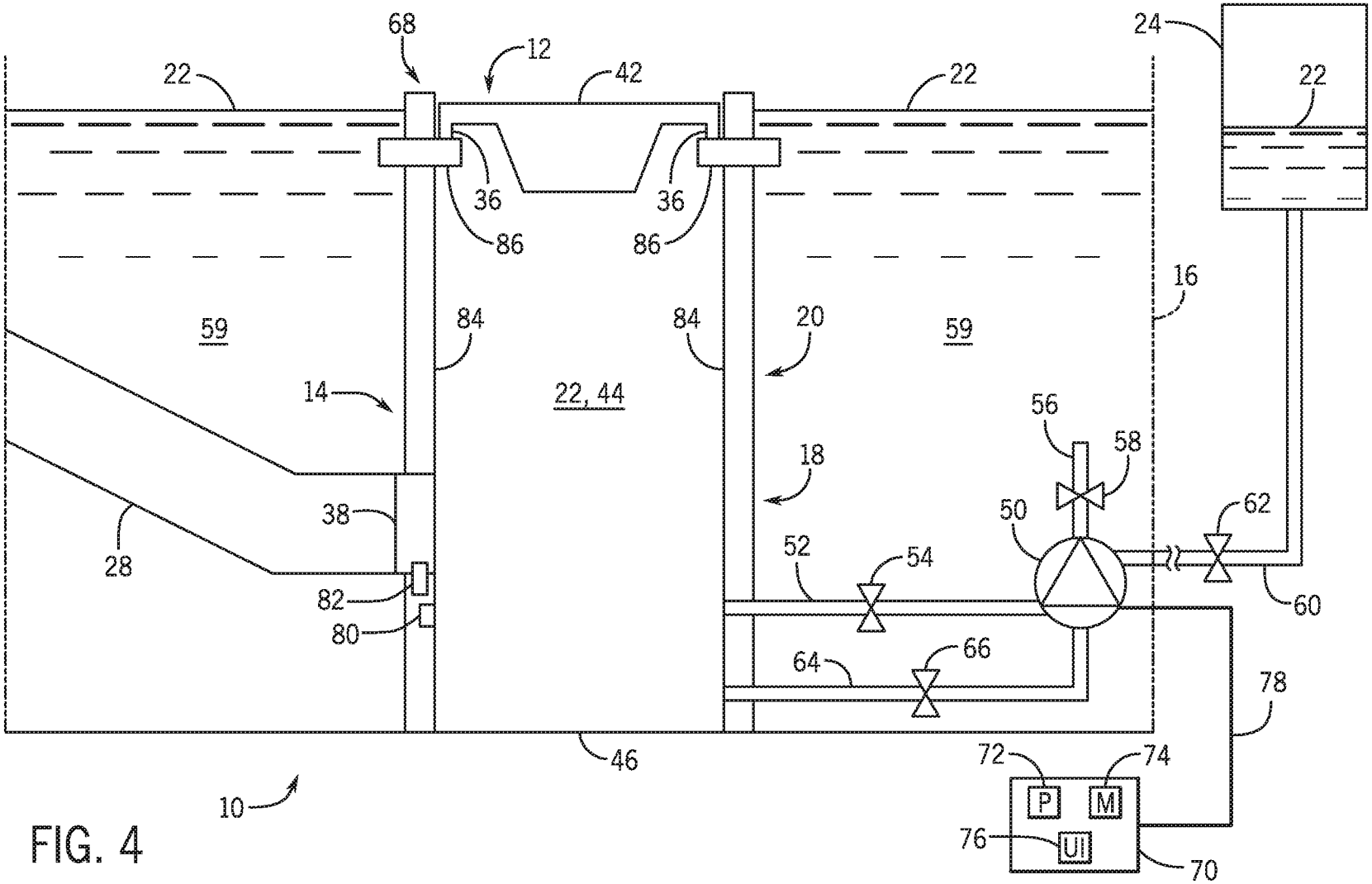
FIG. 4 is a partial cross-sectional side view of an embodiment of the entertainment system of FIG. 1, in accordance with aspects of the present disclosure.

FIG. 4 is a partial cross-sectional side view of an embodiment of the entertainment system 10 of FIG. 1. The illustrated embodiment shows the entertainment platform 12 of the entertainment system 10 disposed within the top portion 20 of the cylinder 14. In the illustrated embodiment, the pump 50 has provided liquid 22 to the first side 44 of the entertainment platform 12 within the cylinder 14 via the fourth conduit 64 and the fourth valve 66. In particular, the pump 50 has moved the liquid 22 from the reservoir 24 via the third conduit 60 and the third valve 62 and has provided the liquid 22 to the first side 44 via the fourth conduit 64 and the fourth valve 66. As such, a level of the liquid 22 within the reservoir 24 of FIG. 4 is lower compared to a level of the liquid 22 in the reservoir 24 of FIG. 3. In certain embodiments, the liquid 22 provided to the first side 44 may be sourced directly from the body of liquid 16 and/or from another source. Additionally, liquid 22 remains disposed in the main volume 59 of the body of liquid 16. As illustrated, the surface 42 of the entertainment platform 12 is generally flush with the top surface 68 of the cylinder 14. In certain embodiments, the surface 42 may extend axially higher than the top surface 68 of cylinder 14 such the entertainment platform 12 protrudes from the cylinder 14.

By providing the liquid 22 to the first side 44 of the entertainment platform 12, the entertainment platform 12 may be driven upward from the bottom portion 18 to the top portion 20 of the cylinder 14. As mentioned above, the entertainment platform 12 includes the skirt 36. The skirt 36 may extend from an edge or circumference of the entertainment platform 12. As the entertainment platform 12 moves from the bottom portion 18 toward the top portion 20, and vice versa, the skirt 36 may engage with an inner wall 84 of the cylinder 14, thereby stabilizing the entertainment platform 12 within the cylinder 14 (e.g., may enable the entertainment platform 12 to move smoothly within the cylinder 14 while the performer(s), the object(s), or both, are disposed on the entertainment platform 12).

While disposed at the top portion 20 of the cylinder 14, the performer(s), the object(s), or both, may be positioned on the surface 42 of the entertainment platform 12. The performer(s), the object(s), or both, may perform and entertain while on the surface 42 and may be viewed by the guests in the viewing area. As such, the entertainment system 10 may facilitate a performance while the entertainment platform 12 is disposed at the top portion 20, and the guests may be entertained by the performance.

In certain embodiments, the performer(s), the object(s), or both, may move around the surface 42 while performing. To secure and/or stabilize the entertainment platform 12 while disposed at the top portion 20 (e.g., during a performance), securement mechanism(s) 86 may engage and/or secure the entertainment platform 12 in place. The securement mechanism(s) 86 may secure the entertainment platform 12 such that the entertainment platform 12 does not move relative to the cylinder 14. For example, the securement mechanism(s) 86 may extend into the cylinder 14 to enable contact and/or engagement between the skirt 36 of the entertainment platform 12, the securement mechanism(s) 86, and/or the cylinder 14 to stabilize the entertainment platform 12 within the cylinder 14. In this manner, the entertainment platform 12 may remain level, rotationally static, or both, when positioned at the top portion 20 of the cylinder 14 (e.g., during a performance). Additionally, in some embodiments, the securement mechanism(s) 86 may enable the entertainment platform 12 to remain axially in place at the top portion 20 of the cylinder 14 in the event that liquid 22 is inadvertently removed from the cylinder 14 on the first side 44 of the entertainment platform 12. The securement mechanism(s) 86 may include calipers, locking bars, grips, wedges, pistons, linkages, splines, gears, or any other suitable elements configured to enable engagement (e.g., rigid engagement) between the entertainment platform 12, the securement mechanism(s) 86, and/or the cylinder 14.

After the performance and/or after another event (e.g., a pre-programmed sequence, a user input provided to the user interface 76, a triggering event, etc.), the securement mechanism(s) 86 may disengage and/or unsecure the entertainment platform 12 to enable the entertainment platform 12 to move from the top portion 20 toward the bottom portion 18 of the cylinder 14. In certain embodiments, the securement mechanism(s) 86 may be communicatively coupled to and controlled by the controller 70. For example, the controller 70 may automatically control the engagement and disengagement of the securement mechanism(s) 86 with the entertainment platform 12 to secure and unsecure the entertainment platform 12 in accordance with a pre-programmed sequence, a user input, a triggering event, another control action, or a combination thereof. In certain embodiments, the entertainment system 10 may include other feature(s) to stabilize and/or secure the entertainment platform 12 within the cylinder 14.

In certain embodiments, the first side 44 of the entertainment platform 12 within the cylinder 14 may be filled with liquid 22 to support or to assist in supporting the entertainment platform 12 as the entertainment platform 12 is raised to the top portion 20 and/or held in place at the top portion 20. In such embodiments, the sensor 80 may detect the presence of liquid 22 within the cylinder 14 and may output signal(s) to the controller 70 and/or to another controller indicative the presence of the liquid 22 within the cylinder 14. In response, the controller 70 and/or other controller may automatically output signal(s) to the locking mechanism 82 to cause the locking mechanism 82 to lock the access panel 38 to prevent opening of the access panel 38. In certain embodiments, if liquid 22 is removed from the first side 44 while the entertainment platform 12 is disposed at the top portion 20, the controller 70 may output signal(s) to the locking mechanism 82 to cause the locking mechanism 82 to lock the access panel 38.

Figure 5:
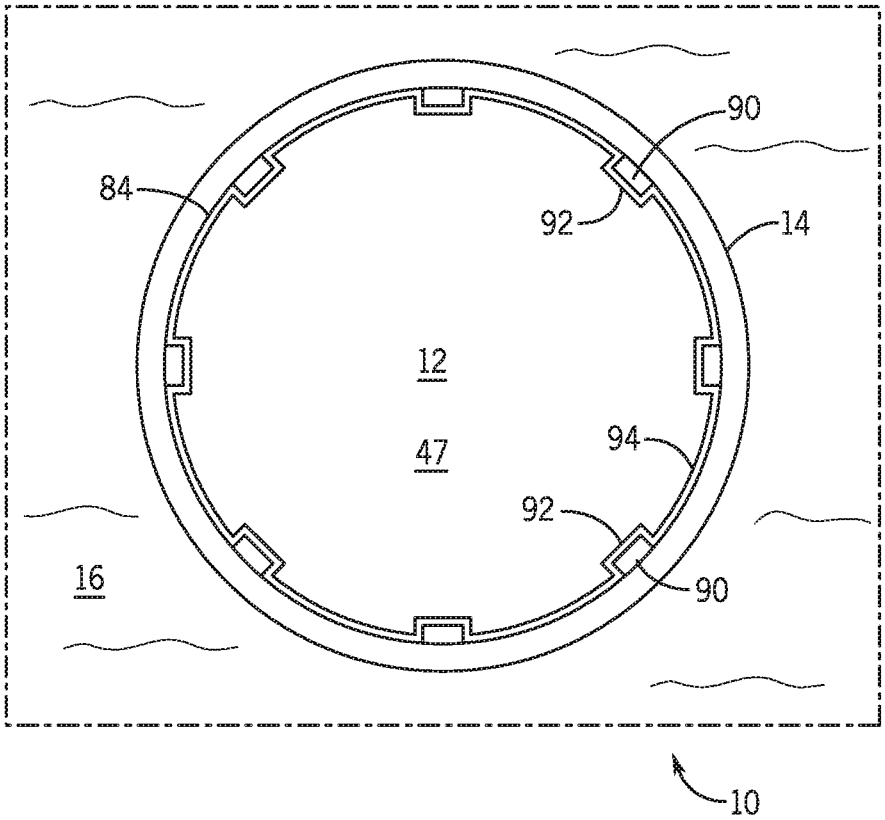
FIG. 5 is a partial top view of an embodiment of the entertainment system of FIG. 1, in accordance with aspects of the present disclosure.

FIG. 5 is a partial top view of an embodiment of the entertainment system 10 of FIG. 1. The entertainment system 10 includes the cylinder 14 disposed within the body of liquid 16 and the entertainment platform 12 disposed within the cylinder 14. As illustrated, the cylinder 14 does not include liquid disposed on the second side 47 of the entertainment platform 12 (e.g., above the entertainment platform 12). Additionally, in the illustrated embodiment, the cylinder 14 includes tracks 90 extending radially inward, relative to the central axis of the cylinder 14, from the inner wall 84 of the cylinder 14. Additionally, the entertainment platform 12 includes track guides 92 formed in the circumference 94 of the entertainment platform 12. Each track 90 is configured to engage a respective track guide 92 to stabilize the entertainment platform 12 while the entertainment platform 12 moves within the cylinder 14 and/or while the entertainment platform 12 is stationary within the cylinder 14. In particular, the engagement between the tracks 90 and track guides 92 may enable the entertainment platform 12 to remain substantially level and/or rotationally static within the cylinder 14. For example, the tracks 90 and the track guides 92 may be included in the entertainment system 10 in addition to or instead of the skirt 36 to stabilize or assist in stabilizing the entertainment platform 12 within the cylinder 14.

As illustrated, the tracks 90 of the cylinder 14 extend from the inner wall 84 of the cylinder 14 into the track guides 92 of the entertainment platform. In certain embodiments, the entertainment platform 12 may additionally or alternatively include tracks that extend into track guides of the cylinder 14. Additionally, while the illustrated embodiment includes eight tracks 90 and eight track guides 92, other embodiments may include more or fewer tracks 90 (e.g., one track 90, two tracks 90, three tracks 90, four tracks 90, five tracks 90, six tracks 90, seven tracks 90, nine tracks 90, etc.) and more or fewer track guides 92 (e.g., one track guide 92, two track guides 92, three track guides 92, four track guides 92, five track guides 92, six track guides 92, seven track guides 92, nine track guides 92, etc.). Further, certain embodiments of the entertainment system 10 may include other components in addition to or instead of the tracks 90, the track guides 92, and the skirt 36 to stabilize or assist in stabilizing the entertainment platform 12 within the cylinder 14.

Figure 6:
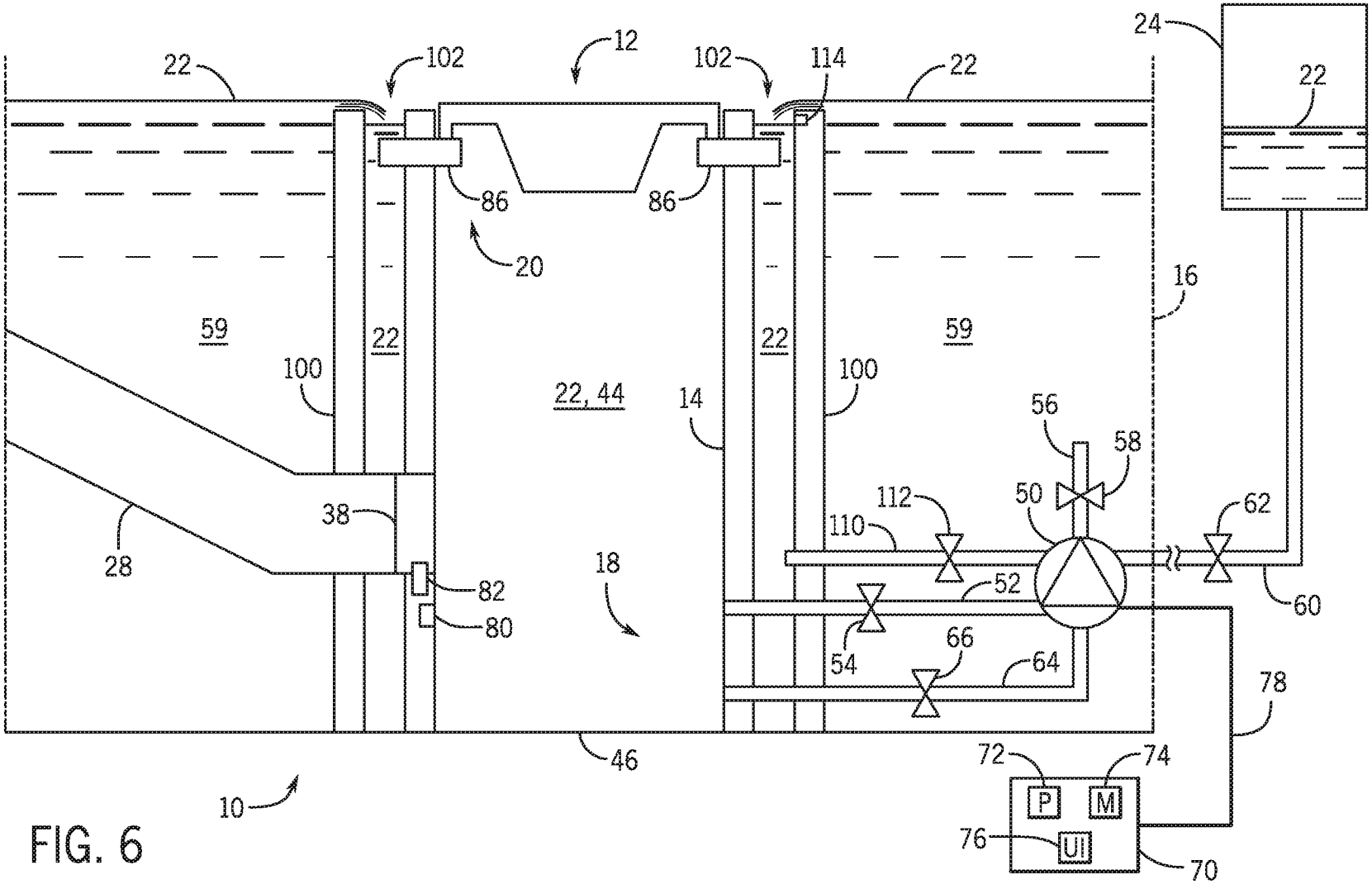
FIG. 6 is a partial cross-sectional side view of an embodiment of the entertainment system of FIG. 1, in accordance with aspects of the present disclosure.

FIG. 6 is a partial cross-sectional side view of an embodiment of the entertainment system 10 of FIG. 1. As illustrated, the entertainment system 10 includes a second cylinder 100 disposed generally about or radially outward from the cylinder 14 (e.g., a first cylinder) such that a gap 102 (e.g., an annular gap) is formed between the cylinder 14 and the second cylinder 100. The entertainment system 10 may be configured to flow liquid 22 from the body of liquid 16, over the second cylinder 100, and into the gap 102 to provide an appearance that the entertainment platform 12 is floating within the body of liquid 16 and/or to further hide, obscure, or camouflage the entertainment platform 12 and/or the cylinder 14 of the entertainment system 10 from the perspective of the guests viewing the entertainment platform 12 from the viewing area.

For example, as illustrated, the entertainment system 10 includes the entertainment platform 12 disposed at the top portion 20 of the cylinder 14. While the liquid 22 flows over the second cylinder 100 and into the gap 102, the liquid 22 may appear to be flowing onto the entertainment platform 12 from a perspective of the guests disposed in the viewing area. The movement of the liquid 22 over the second cylinder 100 and into the gap 102 may also hide or camouflage the entertainment platform 12 from the view of the guests disposed in the viewing area. As such, the embodiment of the entertainment system 10 of FIG. 6 may provide an enhanced entertainment experience for the guests. For example, the performer(s), the object(s), and/or the other aspects of the performance may appear to be floating on the body of liquid 16.

To circulate and/or move the liquid 22 to and/or from the gap 102, the entertainment system 10 may include a fifth conduit 110 and a fifth valve 112. As illustrated, the pump 50 is coupled to the fifth conduit 110. The fifth conduit 110 extends from the pump 50, through the second cylinder 100, and into the gap 102 between the cylinder 14 and the second cylinder 100. The fifth conduit 110 and the fifth valve 112 are configured to flow the liquid 22 from the gap 102 to the pump 50, and vice versa. For example, prior to, during, and after a performance by the performer(s) and/or the object(s) on the entertainment platform 12, the fifth valve 112 may open to enable the pump 50 to remove liquid 22 from the gap 102. As a result, liquid 22 may flow out of the gap 102 along the fifth conduit 110 and toward the pump 50. In certain embodiments, the fifth conduit 110 may flow liquid 22 back into the gap 102 to fill the gap 102.

The liquid 22 moved by the pump 50 from the gap 102 may be directed by the pump 50 into the main volume 59 of the body of liquid 16 to cause the liquid 22 in the main volume 59 to flow over the second cylinder 100 and into the gap 102. In certain embodiments, the liquid 22 moved by the pump 50 from the gap 102 may be directed toward the reservoir 24 via the third conduit 60 and the third valve 62 for storage. Further, in some embodiments, the liquid 22 stored in the reservoir 24 may be moved back into the main volume 59 via the third conduit 60, the third valve 62, the second conduit 56, and the second valve 58. As such, the liquid 22 moved by the pump 50 from the gap 102 and/or the reservoir 24 may be pumped into the main volume 59 to cause the liquid 22 in the main volume 59 to rise and flow over the second cylinder 100 and into the gap 102.

In certain embodiments, the entertainment system 10 may include a gap sensor 114 configured to detect a level of the liquid 22 within the gap 102 (e.g., the level of the liquid 22 between the cylinder 14 and the second cylinder 100). The gap sensor 114 may be communicatively coupled to the controller 70 and/or another controller of the entertainment system 10. The gap sensor 114 may detect the level of the liquid 22 within the gap 102 and output a signal indicative of the level of the liquid 22 to the controller 70. In response, the controller 70 may output signal(s) to the pump 50 to cause the pump 50 to adjust one or more flow rates through the second conduit 56, the third conduit 60, the fifth conduit 110, or a combination thereof, to maintain a level of the liquid 22 within the gap 102 below a liquid level threshold and/or to maintain a flowrate of the liquid 22 over the second cylinder 100. The threshold level of the liquid 22 within the gap 102 and/or the flowrate of the liquid 22 over the second cylinder 100 may be determined automatically by the controller 70 or may be determined based on user input(s) to the user interface 76. Implementation of the gap sensor 114 and associated controller 70 functions may ensure that a liquid level within the gap 102 does not rise to an undesirable point and/or flow onto the entertainment platform 12. Indeed, in embodiments without the second cylinder 100, a similar liquid level sensor may be positioned on the cylinder 14 (e.g., at a top of the cylinder 14) or elsewhere in the body of liquid 16 to ensure that a liquid level of the body of liquid 16 does not rise beyond a predetermined threshold during some operations of the entertainment system 10. As similarly discussed above, the liquid level of the body of liquid 16 may be maintained below a threshold level to ensure that liquid 22 does not flow over the cylinder 14 and onto the entertainment platform 12 during a performance or during certain operations of the entertainment system 10. Based on detection of the liquid level sensor, the controller 70 may control operation of the entertainment system 10 (e.g., pumps, valves, etc.) to maintain the liquid level of the body of liquid 16 below the predetermined threshold.

Additionally, in the illustrated embodiment of FIG. 6, the entertainment system 10 may function differently or the same as the embodiment of the entertainment system 10 of FIGS. 2-4. For example, while the entertainment platform 12 is disposed generally in the bottom portion 18 of the cylinder 14 (e.g., prior to and/or after a performance on the entertainment platform 12), the second side 47 of the entertainment platform 12 (e.g., above the entertainment platform 12 within the cylinder 14) may remain void of the liquid 22. As such, the liquid 22 may merely be provided to and removed from the first side 44 of the entertainment platform 12 within the cylinder 14 to cause the entertainment platform 12 to raise and lower, respectively.

One or more of the disclosed embodiments, alone or on combination, may provide one or more technical effects including the entertainment platform of the entertainment system that may move within the cylinder of the entertainment system based on the addition or removal of liquid from the cylinder. The entertainment platform may serve as a stage for a performance by performer(s), object(s), and/or other elements of the performance. The entertainment platform and the cylinder may be positioned within the body of liquid of the entertainment system. The guests in the viewing area adjacent to and/or on the body of liquid may initially view the body of liquid, while the entertainment platform and the cylinder are submerged and hidden within the body of liquid. The entertainment platform may then be actuated within the cylinder to appear within the view of the guests. The performer(s), the object(s), and/or the other aspects of the performance may be disposed on the entertainment platform and may entertain and complete the performance for viewing by the guests. After the performance and/or after another event, the platform may disappear from the view of the guests and may move back down into the cylinder and the body of liquid. After the performer(s), the object(s), and/or the other aspects of the performance exit the entertainment platform and the cylinder, the entertainment system may refill the cylinder and the body of liquid. As such, the entertainment system may provide an entertaining and exciting venue for the guests to view the performance. The technical effects and technical problems in the specification are exemplary and are not limiting. It should be noted that the embodiments described in the specification may have other technical effects and can solve other technical problems.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the disclosed subject matter. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An entertainment system, comprising:
a cylinder disposed within a body of liquid;
an entertainment platform disposed within the cylinder, wherein the entertainment platform is configured to move within the cylinder; and
a pump system configured to remove fluid from and provide fluid to an interior of the cylinder on a first side of the entertainment platform to move the entertainment platform within the cylinder, wherein the pump system is configured to remove fluid from the cylinder on the first side of the entertainment platform and configured to direct the fluid to a location external to the cylinder to store the fluid, wherein the cylinder comprises an access panel coupled to a bottom portion of the cylinder, and wherein the access panel is configured to enable access for at least one performer, at least one object, or both to enter the interior of the cylinder from a passageway exterior of and extending from the bottom portion of the cylinder.

2. The entertainment system of claim 1, wherein the cylinder comprises one or more tracks, and wherein the entertainment platform is configured to engage with the one or more tracks to guide movement of the entertainment platform within the cylinder.

3. The entertainment system of claim 1, comprising a first conduit extending from the pump system to the interior of the cylinder on the first side of the entertainment platform.

4. The entertainment system of claim 3, comprising a second conduit extending from the pump system to the interior of the cylinder, wherein the second conduit is disposed on a second side of the entertainment platform opposite the first side when the entertainment platform is positioned at the bottom portion of the cylinder.

5. The entertainment system of claim 4, comprising a third conduit extending from the pump system to a main volume of the body of liquid.

6. The entertainment system of claim 5, comprising:
a reservoir configured to store a liquid; and
a fourth conduit extending from the pump system to the reservoir.

7. The entertainment system of claim 1, comprising the passageway, wherein the passageway comprises a first end coupled to the cylinder and a second end disposed external to the body of liquid.

8. An entertainment system, comprising:
a body of liquid;
a cylinder comprising a top portion and a bottom portion, wherein the cylinder is disposed within the body of liquid;
an entertainment platform disposed within an interior of the cylinder, wherein the entertainment platform is configured to move axially within the cylinder between a first position at the bottom portion and a second position at the top portion;
a pump system;
a first conduit fluidly coupling the pump system and the interior of the cylinder at the bottom portion, wherein the pump system is configured to selectively provide and remove a flow of the liquid to and from the interior of the cylinder at the bottom portion to move the entertainment platform between the first position and the second position;
a reservoir configured to store the liquid, wherein the reservoir is external to the cylinder; and
a second conduit fluidly coupling the pump system and the reservoir, wherein the pump system is configured to remove the liquid from the interior of the cylinder at the bottom portion and configured to direct the liquid to the reservoir to store the liquid, wherein when the entertainment platform is located and maintained at the first position at the bottom portion of the cylinder, the pump system is configured to remove all of the liquid above the entertainment platform.

9. The entertainment system of claim 8, wherein the pump system is configured to provide the flow of the liquid to the interior of the cylinder at the bottom portion from the body of liquid.

10. The entertainment system of claim 8, wherein the pump system is configured to provide the flow of the liquid to the interior of the cylinder at the bottom portion from the reservoir.

11. The entertainment system of claim 8, wherein the entertainment platform comprises a skirt disposed about a circumference of the entertainment platform, wherein the skirt is configured to engage with the cylinder to stabilize the entertainment platform within the cylinder.

12. The entertainment system of claim 8, comprising a sensor disposed within the interior of the cylinder, wherein the sensor is configured to detect a presence of the liquid in the interior of the cylinder.

13. The entertainment system of claim 12, wherein the cylinder comprises an access panel disposed at the bottom portion and a locking mechanism, and wherein the locking mechanism is configured to lock the access panel in a closed position in response to the presence of the liquid detected by the sensor.

14. The entertainment system of claim 8, comprising a securement mechanism coupled to the cylinder and disposed at the top portion of the cylinder, wherein the securement mechanism is configured to engage with the entertainment platform and secure the entertainment platform in place in the second position.

15. A method of providing an entertainment platform in a body of liquid, the method comprising:

removing liquid from an interior of a cylinder on a first side of the entertainment platform, wherein the entertainment platform is disposed within the cylinder, and wherein the cylinder is disposed within the body of liquid;

providing liquid to the interior of the cylinder on a second side of the entertainment platform to lift the entertainment platform within the cylinder;

removing the liquid from the interior of the cylinder on the second side of the entertainment platform to lower the entertainment platform within the cylinder;

directing the liquid removed from the interior of the cylinder on the second side of the entertainment platform to a reservoir external to the cylinder to store the liquid; and enabling access for at least one performer, at least one object, or both from a passageway, exterior of the cylinder, to the entertainment platform within the cylinder via an access panel of the cylinder after removing the liquid from the interior of the cylinder on the first side of the entertainment platform and when the entertainment platform is disposed within a bottom portion of the cylinder.

16. The method of claim 15, comprising storing the liquid removed from the interior of the cylinder on the first side of the entertainment platform in the reservoir, wherein the reservoir is separate from the body of liquid.

17. The method of claim 16, wherein providing liquid to the interior of the cylinder on the second side of the entertainment platform comprises:

providing liquid from the reservoir to the second side of the entertainment platform;

providing liquid from the body of liquid to the second side of the entertainment platform; or both.

18. The method of claim 15, comprising providing liquid to the body of liquid to raise a liquid level of the body of liquid above a top portion of the cylinder after removing the liquid from the interior of the cylinder on the second side of the entertainment platform to lower the entertainment platform within the cylinder.

* * * * *